US006810379B1

(12) United States Patent
Vermeulen et al.

(10) Patent No.: US 6,810,379 B1
(45) Date of Patent: Oct. 26, 2004

(54) CLIENT/SERVER ARCHITECTURE FOR TEXT-TO-SPEECH SYNTHESIS

(75) Inventors: Pieter Vermeulen, Hillsboro, OR (US); Todd F. Mozer, Sunnyvale, CA (US)

(73) Assignee: Sensory, Inc., Santa Clara, CA (US)

( * ) Notice: Subject to any disclaimer, the term of this patent is extended or adjusted under 35 U.S.C. 154(b) by 501 days.

(21) Appl. No.: 09/842,358

(22) Filed: Apr. 24, 2001

Related U.S. Application Data

(60) Provisional application No. 60/199,292, filed on Apr. 24, 2000.

(51) Int. Cl.[7] ..... G10L 13/08; G10L 13/02; G10L 13/04

(52) U.S. Cl. ..... 704/260; 704/258; 704/261

(58) Field of Search ..... 704/260, 200, 704/258, 246, 270.1, 268, 261, 264, 270; 340/514

(56) References Cited

U.S. PATENT DOCUMENTS 4,130,730 A * 12/1978 Ostrowski ..... 704/264
4,412,211 A * 10/1983 Lautzenheiser et al. ..... 340/514
4,470,150 A * 9/1984 Ostrowski ..... 704/261
4,979,216 A * 12/1990 Malsheen et al. ..... 704/260
5,673,362 A * 9/1997 Matsumoto ..... 704/260
5,886,276 A * 3/1999 Levine et al. ..... 704/268
5,940,796 A 8/1999 Matsumoto ..... 704/260
5,943,648 A * 8/1999 Tel ..... 704/270.1
6,055,498 A * 4/2000 Neumeyer et al. ..... 704/246
6,081,780 A * 6/2000 Lumelsky ..... 704/260
6,161,091 A * 12/2000 Akamine et al. ..... 704/258
6,230,130 B1 * 5/2001 Castello da Costa et al. .... 704/258
6,246,672 B1 * 6/2001 Lumelsky ..... 704/260
6,505,158 B1 * 1/2003 Conkie ..... 704/260
6,510,413 B1 * 1/2003 Walker ..... 704/258
6,625,576 B2 * 9/2003 Kochanski et al. ..... 704/260
6,678,659 B1 * 1/2004 Van Kommer ..... 704/260

FOREIGN PATENT DOCUMENTS

EP 542628 A2 * 11/1992 ..... G10L/5/04

OTHER PUBLICATIONS

U.S. patent application Ser. No. 60/199,292, Mozer, filed Apr. 2000.*

* cited by examiner

*Primary Examiner*—Vijay Chawan
*Assistant Examiner*—Daniel A. Nolan
(74) *Attorney, Agent, or Firm*—Lumen Intellectual Property Services, Inc.

(57) ABSTRACT

A client/server text-to-speech synthesis system and method divides the method optimally between client and server. The server stores large databases for pronunciation analysis, prosody generation, and acoustic unit selection corresponding to a normalized text, while the client performs computationally intensive decompression and concatenation of selected acoustic units to generate speech. The units are transmitted from the client to the server in a highly compressed format, with a compression method selected based on the predetermined set of potential acoustic units. This compression method allows for very high-quality and natural-sounding speech to be output at the client machine.

32 Claims, 1 Drawing Sheet

CLIENT/SERVER ARCHITECTURE FOR TEXT-TO-SPEECH SYNTHESIS

CROSS-REFERENCE TO RELATED APPLICATIONS

This application claims the benefit of U.S. Provisional Application No. 60/199,292, filed Apr. 24, 2000, which is herein incorporated by reference.

FIELD OF THE INVENTION

This invention relates generally to text-to-speech synthesis. More particularly, it relates to a client/server architecture for very high quality and efficient text-to-speech synthesis.

BACKGROUND ART

Text-to-speech (TTS) synthesis systems are useful in a wide variety of applications such as automated information services, auto-attendants, avatars, computer-based instruction, and computer systems for the vision impaired. An ideal system converts a piece of text into high-quality, natural-sounding speech in near real time. Producing high-quality speech requires a large number of potential acoustic units and complex rules and exceptions for combining the units, i.e., large storage capability and high computational power. A prior art text-to-speech system 10 is shown schematically in FIG. 1. An original piece of text is converted to speech by a number of processing modules. The input text specification usually contains punctuation, abbreviations, acronyms, and non-word symbols. A text normalization unit 12 converts the input text to a normalized text containing a sequence of non-abbreviated words only. Most punctuation is useful in suggesting appropriate prosody, and so the text normalization unit 12 filters out punctuation to be used as input to a prosody generation unit 16. Other punctuation is extraneous and filtered out completely. Abbreviations and acronyms are converted to their equivalent word sequences, which may or may not depend on context. The most complex task of the text normalization unit 12 is to convert symbols to word sequences. For example, numbers, currency amounts, dates, times, and email addresses are detected, classified, and then converted to text that depends on the symbol's position in the sentence. The normalized text is sent to a pronunciation unit 14 that first analyzes each word to determine its simplest morphological representation. This is trivial in English, but in a language in which words are strung together (e.g., German), words must be divided into base words and prefixes and suffixes. The resulting words are then converted to a phoneme sequence or its pronunciation. The pronunciation may depend on a word's position in a sentence or its context (i.e., the surrounding words). Three resources are used by the pronunciation unit 14 to perform conversion: letter-to-sound rules; statistical representations that convert letter sequences to most probable phoneme sequences based on language statistics; and dictionaries, which are simple word/pronunciation pairs. Conversion can be performed without statistical representations, but all three resources are preferably used. Rules can distinguish between different pronunciations of the same word depending on its context. Other rules are used to predict pronunciations of unseen letter combinations based on human knowledge. Dictionaries contain exceptions that cannot be generated from rules or statistical methods. The collection of rules, statistical models, and dictionary forms the database needed for the pronunciation unit 14. This database is usually quite large in size, particularly for high-quality text-to-speech conversion.

The resulting phonemes are sent to the prosody generation unit 16, along with punctuation extracted from the text normalization unit 12. The prosody generation unit 16 produces the timing and pitch information needed for speech synthesis from sentence structure, punctuation, specific words, and surrounding sentences of the text. In the simplest case, pitch begins at one level and decreases toward the end of a sentence. The pitch contour can also be varied around this mean trajectory. Dates, times, and currencies are examples of parts of a sentence that are identified as special pieces; the pitch of each is determined from a rule set or statistical model that is crafted for that type of information. For example, the final number in a number sequence is almost always at a lower pitch than the preceding numbers. The rhythms, or phoneme durations, of a date and a phone number are typically different from each other. Usually a rule set or statistical model determines the phoneme durations based on the actual word, its part of the sentence, and the surrounding sentences. These rule sets or statistical models form the database needed for this module; for the more natural sounding synthesizers, this database is also quite large.

The final unit, an acoustic signal synthesis unit 18, combines the pitch, duration and phoneme information from the pronunciation unit 14 and the prosody generation unit 16 to produce the actual acoustic signal. There are two dominant methods in state of the art speech synthesizers. The first is formant synthesis, in which a human vocal track is modeled and phonemes are synthesized by producing the necessary formants. Formant synthesizers are very small, but the acoustic quality is insufficient for most applications. The more widely used high-quality synthesis technique is concatenative synthesis, in which a voice artist is recorded to produce a database of sub-phonetic, phonetic, and larger multi-phonetic units. Concatenative synthesis is a two-step process: deciding which sequence of units to use, and concatenating them in such a way that duration and pitch are modified to obtain the desired prosody. The quality of such a system is usually proportional to the size of the phonetic unit database.

A high quality text-to-speech synthesis system thus requires large pronunciation, prosody, and phonetic unit databases. While it is certainly possible to create and efficiently search such large databases, it is much less feasible for a single user to own and maintain such databases. One solution is to provide a text-to-speech system at a server machine and available to a number of client machines over a computer network. For example, the clients provide the system with a piece of text, and the server transmits the converted speech signal to the user. Standard speech coders can be used to decrease the amount of data transmitted to the client.

One problem with such a system is that the quality of speech eventually produced at the client depends on the amount of data transmitted from the server. Unless an unusually high bandwidth connection is available between the server and the client, the connection is such that an unacceptably long delay is required to receive data producing high quality sound at the client. For typical client applications, the amount of data transmitted must be reduced so that the communication traffic is at an acceptable level. This data reduction is necessarily accompanied by approximations and loss of speech quality. The client/server connection is therefore the limiting factor in determining speech quality, and the high-quality speech synthesis at the server is not fully exploited.

U.S. Pat. No. 5,940,796, issued to Matsumoto, provides a speech synthesis client/server system. A voice synthesizing server generates a voice waveform based on data sent from the client, encodes the waveform, and sends it to the client. The client then receives the encoded waveform, decodes it, and outputs it as voice. There are a number of problems with the Matsumoto system. First, it uses signal synthesis methods such as formant synthesis, in which a human vocal track is modeled according to particular parameters. The acoustic quality of formant synthesizers is insufficient for most applications. Second, the Matsumoto system uses standard speech compression algorithms for compressing the generated waveforms. While these algorithms do reduce the data rate, they still suffer the quality/speed tradeoff mentioned above for standard speech coders. Generic speech coders are designed for the transmission of unknown speech, resulting in adequate acoustic quality and graceful degradation in the presence of transmission noise. The design criteria are somewhat different for a text-to-speech system in which a pleasant sounding voice (i.e., higher than adequate acoustic quality) is desired, the speech is known beforehand, and there is sufficient time to retransmit data to correct for transmission errors. In addition, a client with sufficient CPU resources is capable of implementing a more demanding decompression scheme. Given these different criteria, a more optimal and higher compression methodology is possible.

There is still a need, therefore, for a client/server architecture for text-to-speech synthesis that outputs high-quality, natural-sounding speech at the client.

SUMMARY

Accordingly, the present invention provides a client/server system and method for high-quality text-to-speech synthesis. The method is divided between the client and server such that the server performs steps requiring large amounts of storage, while the client performs the more computationally intensive steps. The data transmitted between client and server consist of acoustic units that are highly compressed using an optimized compression method.

A text-to-speech synthesis method of the invention includes the steps of obtaining a normalized text, selecting acoustic units corresponding to the text from a database that stores a predetermined number of possible acoustic units, transmitting compressed acoustic units from a server machine to a client machine, and, in the client, decompressing and concatenating the units. The selected units are compressed before being transmitted to the client using a compression method that depends on the predetermined number of possible acoustic units. This results in minimal degradation between the original and received acoustic units. For example, parameters of the compression method can be selected to minimize the amount of data transmitted between the server and client while maintaining a desired quality level. The acoustic units stored in the database are preferably compressed acoustic units.

Preferably, the client machine concatenates the acoustic units in dependence on prosody data that the server generates and transmits to the client. The client can also store cached acoustic units that it concatenates with the acoustic units received from the server. Preferably, transmission of acoustic units and concatenation by the client occur simultaneously for sequential acoustic units. The server can also normalize a standard text to obtain the normalized text.

The invention also provides a text-to-speech synthesis method performed in a server machine. The method includes obtaining a normalized text, selecting acoustic units corresponding to the normalized text from a database that stores a predetermined number of possible acoustic units, and transmitting compressed acoustic units to a client machine. The selected acoustic units are compressed using a compression method that depends on the specific predetermined number of possible acoustic units. Specifically, the compression method minimizes the amount of data transmitted by the server while maintaining a desired quality level. Preferably, the acoustic units in the database are compressed acoustic units. The server may also generate prosody data corresponding to the text and transmit the prosody data to the client. It may also normalize a standard text to obtain the normalized text.

Also provided is a text-to-speech synthesis method performed in a client machine. The client receives compressed acoustic units corresponding to a normalized text from a server machine, decompresses the units, and concatenates them, preferably in dependence on prosody data also received from the server. Preferably, the method steps are performed concurrently. The units are selected from a predetermined number of possible units and compressed according to a compression method that depends on the predetermined number of possible units. For example, parameters of the compression method can be selected to minimize the amount of data transmitted to the client machine. The client can also store at least one cached acoustic unit that it concatenates with the received acoustic units. The client can also transmit a standard text to be converted to speech to the server, or it can normalize a standard text and send the normalized text to the server.

The present invention also provides a text-to-speech synthesis system containing a database of predetermined acoustic units, a server machine communicating with the database, and a client machine communicating with the server machine. The server machine selects acoustic units and generates prosody data corresponding to a normalized text and then transmits compressed units and the prosody data to the client. The client machine concatenates the received acoustic units in dependence on the prosody data. The compressed acoustic units are obtained by compressing the selected acoustic units using a compression method that depends on the predetermined acoustic units. Preferably, parameters of the compression method are selected to minimize the data transmitted from the server to the client. The database preferably stores compressed acoustic units. Either the client or server can also normalize a standard text to obtain the normalized text. Preferably, the client stores cached acoustic units that are concatenated with the received acoustic units.

The present invention also provides a program storage device accessible by a server machine and tangibly embodying a program of instructions executable by the server machine to perform method steps for the above-described text-to-speech synthesis method.

DETAILED DESCRIPTION

Although the following detailed description contains many specifics for the purposes of illustration, anyone of ordinary skill in the art will appreciate that many variations and alterations to the following details are within the scope of the invention. Accordingly, the following preferred embodiment of the invention is set forth without any loss of generality to, and without imposing limitations upon, the claimed invention.

The present invention provides a system and method for concatenative text-to-speech synthesis in a client/server architecture. The invention achieves high quality speech synthesis by optimizing division of the method between client and server. The large memory of the server provides storage of the pronunciation, prosody, and acoustic unit databases, which are much too large to be stored on a typical client machine. Very highly compressed acoustic units are transmitted to the client, and the high processing speed of the client provides very fast decompression and concatenation of the acoustic units as they are being received. This architecture allows for a very large database of acoustic units, which is required to generate high-quality and natural-sounding speech.

Figure 2:
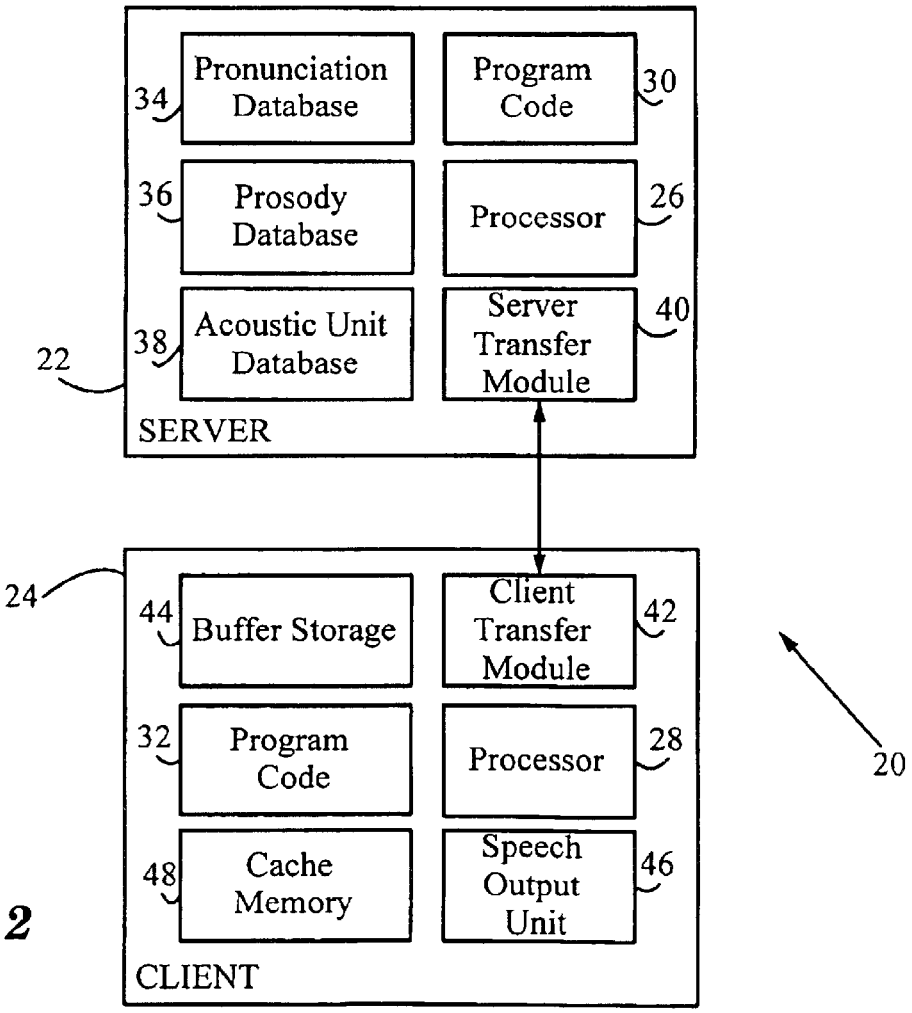
FIG. 2 is a block diagram of a client/server text-to-speech synthesis system of the present invention.

A preferred embodiment of a system 20 of the present invention is shown in FIG. 2. The system 20 contains a server machine 22 communicating with a client machine 24 according to conventional protocols such as XML, HTTP, and TCP/IP. Although only one client machine 24 is shown, the system 20 typically contains many client machines communicating with at least one server 22. For example, the server 22 and client 24 can be connected through the Internet or a Local Area Network (LAN). General characteristics of the system components are high processing speed and low memory of the client 24; high memory and low processing speed of the server 22; and low bandwidth communication network connecting the client 24 and server 22. The server 22 actually has a high processing speed, but because each client has access to only a small portion of this computational power, the server appears relatively weak to each client. It will be apparent to one of average skill in the art that the terms "high" and "low" are defined relative to state of the art hardware and are not limited to particular speeds or capabilities. The present invention exploits these characterizations by minimizing data transfer between client and server, maximizing calculation and minimizing data storage on the client, and minimizing calculation and maximizing data storage on the server.

Methods of the invention are executed by processors 26 and 28 of the server 22 and client 24, respectively, under the direction of computer program code 30 and 32 stored within the respective machines. Using techniques well known in the computer arts, such code is tangibly embodied within a computer program storage device accessible by the processors 26 and 28, e.g., within system memory or on a computer readable storage medium such as a hard disk or CD-ROM. The methods may be implemented by any means known in the art. For example, any number of computer programming languages, such as Java, C++, or LISP may be used. Furthermore, various programming approaches such as procedural or object oriented may be employed.

Figure 1:
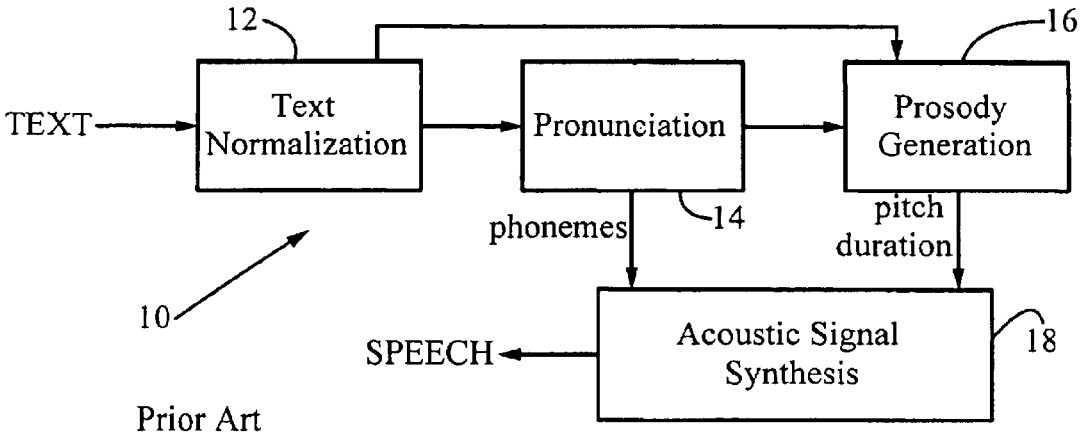
FIG. 1 is a block diagram of a text-to-speech synthesis system of the prior art.

The invention performs concatenative synthesis generally according to the method outlined in FIG. 1. The first three steps, text normalization 12, pronunciation analysis 14, and prosody generation 16, and the first step of acoustic signal synthesis 18, acoustic unit selection, are preferably performed by the server 22. These steps are relatively computationally inexpensive but require large database storage in order to produce high-quality, natural-sounding speech. A pronunciation database 34 stores at least one of three types of data used to determine pronunciation: letter-to-sound rules, including context-based rules and pronunciation predictions for unknown words; statistical models, which convert letter sequences to most probable phoneme sequences based on language statistics; and dictionaries, which contain exceptions that cannot be derived from rules or statistical methods. A prosody database 36 contains rule sets or statistical models that determine phoneme durations and pitch based on the word and its context. Finally, an acoustic unit database 38 stores sub-phonetic, phonetic, and larger multi-phonetic acoustic units that are selected to obtain the desired phonemes. The total number and identity of each acoustic unit in the database 38 is known; i.e., the database 38 stores a predetermined number of possible acoustic units. The quality of synthesized speech is typically proportional to the size of the acoustic unit database 38. These steps and their associated databases are known in the art and will not be described herein.

Although the databases 34, 36, and 38 are illustrated as being stored in the memory of the server 22, it will be apparent to those of skill in the art that the databases can be distributed among a number of servers in communication with server 22. Server 22 queries the various databases using conventional methods and communication protocols to obtain the desired data.

The server processor 26, under instruction from program code 30, performs text normalization, pronunciation analysis, prosody generation, and acoustic unit selection using the databases 34, 36, and 38. A server transfer module 40 then obtains the selected acoustic units and prosody data and transmits them to the client machine 24, which concatenates the units to obtain speech. The acoustic units that are sent to the client machine are highly compressed using a compression method of the present invention. Preferably, the units are stored in the acoustic unit database 38 as compressed acoustic units; i.e., compression is done offline so that compression computations are not required during speech synthesis.

A key feature of the compression is that it is optimized to provide high compression while maintaining high quality of the transmitted acoustic units. This can be accomplished because the database contains a finite and predetermined number of acoustic units. Thus the invention does not address a generic speech compression problem, but is rather directed toward the predetermined set of acoustic units stored in the database 38. In contrast, standard speech coders must compress a continuous stream of speech, which is not divided into fundamental, reusable units, and must allow for all speech possibilities, rather than a predetermined set of acoustic units. They therefore require significant approximations and can be quite lossy, reducing the resulting speech quality significantly. A preferred compression algorithm is discussed below.

The client computer 24 receives the compressed acoustic units and prosody data from the server 22 using a client transfer module 42, e.g. an Internet connection. The incoming data is stored in a relatively small buffer storage 44 before being processed by the client processor 28 according to the program code instructions 32. Preferably, particular compressed acoustic units and prosody data are processed by the client 24 as soon as they are received, rather than after all of the data have been received. That is, the acoustic units are streamed to the client 24, and speech is output as new units are received. Thus for sequential acoustic units, reception, processing, and output occur simultaneously. Streaming is an efficient method for processing large amounts of data, because it does not require an entire file to be transmitted to and stored in the client 24 before processing begins. The data are not retained in memory after being processed and output.

The server transfer module 40 and client transfer module 42 can be any suitable complementary mechanisms for transmitting data. For example, they can be network connections to an intranet or to the Internet. They can also be wireless devices for transmitting electromagnetic signals.

Processing by the client machine includes retrieving the compressed acoustic units from the buffer 44, decompressing them, and then pitch shifting, compressing, or elongating the decompressed units in accordance with the received prosody data. These steps are relatively computationally intensive and take advantage of the high processing speed of the client processor 28. The units are then concatenated and sent to a speech output unit 46 (e.g., a speaker) that contains a digital-to-analog converter and outputs speech corresponding to the concatenated acoustic units.

Preferably, a small number of uncompressed acoustic units are cached in a cache memory 48 of the client 24. The processor 28 can access the cache memory 48 much more quickly than it can access the client's main memory. Frequently used acoustic units are cached on the client 24 so that the server 22 does not need to transmit such units repeatedly. Clearly, there is a tradeoff between memory storage and transmission bandwidth: the more frequently-used units that are stored in the cache 48, the fewer the units that must be transmitted. The number of cached units can be adjusted depending on the available client memory and transmission capabilities. The server 22 has information about which units are cached on which client machine. When the server 22 selects a unit that is cached on the relevant client machine, it transmits only an identifier of the unit to the client, rather than the compressed unit itself. During decompression, the client determines that the transmitted data includes an identifier of a cached unit and quickly retrieves the unit from the cache 48.

The present invention can be implemented with any compression method that optimizes compression based on the fact that the complete set of possible acoustic units is known. The following example of a suitable compression method is intended to illustrate one possible compression method, but does not limit the scope of the present invention. In a currently preferred embodiment of the compression method, each acoustic unit is divided into sequences of chunks of equal duration (e.g., 10 milliseconds). Each chunk is described by a set of parameters describing the frequency composition of the chunk according to a known model. For example, the parameters can include line spectral pairs of a Linear Predictive Coding (LPC) model. One of the parameters indicates the number of parameters used, e.g., the number of line spectral pairs used to describe a single chunk. The higher the number of parameters used, the more accurate will be the decompressed unit. The chunk is regenerated using the model and the parameter set, and a residual, the difference between the original and regenerated chunk, is obtained. The residual is modeled as, for example, a set of carefully placed impulses. The set of LPC parameters describing the full database can, in addition, be quantized into a small set of parameter vectors, or a codebook. The same quantization can be performed on the residual vectors to reduce the description of each frame to two indices: that of the LPC vector and that of the residual vector.

Given this framework for the compression method, the method is optimized to select the number of parameters. Using a directed optimized search, the number of parameters for the frequency model and the number of impulse models for the residual are selected. The search is directed by an acoustic metric that measures quality. This metric is a combination of indirect measures such as a least mean squared difference between the encoded speech and the original, which can be used in, e.g., a gradient descent search, as well as perceptual measures such as a group of people grading the perceived quality, which post-qualifies a parameter set. The frequency model numbers and residual are then coded through an optimally selected codebook that uses the least possible number of code words to describe the known database. The indices to code words are the compressed acoustic units that are transmitted from the server 22 to the client 24.

In a typical application, the client machine 24 has a standard text that it would like converted into speech. As used herein, a standard text is one that has not yet been normalized and therefore may contain punctuation, abbreviations, acronyms, numbers of various format (currency amounts, dates, times), email addresses, and other symbols. The client machine 24 transmits its standard text to the server 22, which begins the process by normalizing the standard text as described above. Transmitting the standard text from the client to the server does not affect the transmission of compressed acoustic units from server to client, because text transmission requires relatively little bandwidth. Alternatively, the server 22 may receive the text and client identifier from a different source, or it may generate the text itself.

Although the system of the invention has been described with respect to a standard client/server computer architecture, it will be apparent to one of average skill in the art that many variations to the architecture are within the scope of the present invention. For example, the client machine can be a dedicated device containing only a processor, small memory, and voice output unit, such as a Personal Digital Assistant (PDA), cellular telephone, information kiosk, or speech playback device. The client and server can also communicate through wireless means. The steps performed by the server can be performed on multiple servers in communication with each other. It is to be understood that the steps described above are highly simplified versions of the actual processing performed by the client and server machines, and that methods containing additional steps or rearrangement of the steps described are within the scope of the present invention.

It will be clear to one skilled in the art that the above embodiment may be altered in many ways without departing from the scope of the invention. Accordingly, the scope of the invention should be determined by the following claims and their legal equivalents.

What is claimed is:

1. In a computer system comprising a server machine and a client machine, a text-to-speech synthesis method comprising:

describing a finite number of possible acoustic units;

optimizing a compression method selected in dependence of said finite number of possible acoustic units, wherein said optimizing step further comprises selecting parameters of said compression method utilizing a directed optimized search to minimize the amount of data transmitted between said server machine and said client machine;

compressing said finite number of possible acoustic units via said optimized compression method;

storing said finite number of possible acoustic units as compressed acoustic units in an acoustic unit database accessible to said server machine;

in said server machine, obtaining a normalized text and generating prosody data thereof;

selecting from said acoustic unit database compressed acoustic units that correspond to said normalized text;

transmitting said prosody data and said selected compressed acoustic units from said server machine to said client machine; and in said client machine, decompressing said transmitted acoustic units and concatenating said decompressed acoustic units in accordance with said prosody data.

2. The method of claim 1, wherein said decompressing step and said concatenating step begin before all of said selected compressed acoustic units and said prosody data are received in said client machine.

3. The method of claim 1, further comprising:

caching a number of frequently used uncompressed acoustic units in a cache memory of said client machine; and concatenating said decompressed acoustic units with at least one of said uncompressed acoustic units.

4. The method of claim 1, further comprising normalizing a standard text to obtain said normalized text.

5. The method of claim 1, further comprising:

sending a standard text to said server machine;

in said server machine, normalizing said standard text to obtain said normalized text.

6. The method of claim 1, wherein said optimized search is directed by an acoustic metric that measures quality.

7. The method of claim 1, wherein said describing step further comprises:

dividing each of said possible acoustic units into sequences of chunks of equal duration; and describing frequency composition of each chunk with a set of parameters.

8. A text-to-speech synthesis system programmed to perform the method of claim 1, said text-to-speech synthesis system comprising:

said acoustic unit database;

said server machine in communication with said acoustic unit database; and said client machine in communication with said server machine.

9. A computer-readable program storage device tangibly embodying a computer-executable program implementing the text-to-speech synthesis method of claim 1.

10. In a computer system comprising a server machine and a client machine, a text-to-speech synthesis method comprising:

in said server machine, obtaining a normalized text;

selecting compressed acoustic units corresponding to said normalized text from a database storing a predetermined number of possible acoustic units that have been optimally compressed;

transmitting said selected compressed acoustic units to said client machine;

generating prosody data corresponding to said normalized text and transmitting said prosody data to said client machine;

in said client machine, decompressing said transmitted acoustic units; and concatenating said decompressed acoustic units.

11. The method of claim 10, further comprising normalizing a standard text to obtain said normalized text.

12. The method of claim 10, wherein said decompressing step and said concatenating step begin before all of said selected compressed acoustic units are received in said client machine.

13. The method of claim 10, further comprising:

determining a compression method in dependence of said predetermined number of possible acoustic units; and selecting parameters of said compression method utilizing an optimized search directed by an acoustic metric that measures quality to minimize the amount of data transmitted to said client machine while maintaining a minimum acoustic quality for each of said possible acoustic units.

14. The method of claim 10, further comprising:

caching a number of frequently used uncompressed acoustic units in a cache memory of said client machine; and concatenating said decompressed acoustic units with at least one of said uncompressed acoustic units.

15. A text-to-speech synthesis system programmed to perform the method of claim 10, said text-to-speech synthesis system comprising:

said acoustic unit database;

said server machine;

said client machine; and means for enabling data transmission and communication among said acoustic unit database, said server machine, and said client machine.

16. A computer-readable medium storing a computer-executable program implementing the text-to-speech synthesis method of claim 10.

17. In a client machine, a text-to-speech synthesis method comprising:

a) receiving compressed acoustic units corresponding to a normalized text from a server machine, said compressed acoustic units being selected from a predetermined number of possible acoustic units and compressed using a compression method selected in dependence on said predetermined number of possible acoustic units;

b) decompressing said compressed acoustic units to obtain decompressed acoustic units;

c) receiving prosody data corresponding to said normalized text from said server machine; and d) concatenating said decompressed acoustic units in dependence of said prosody data.

18. The method of claim 17 wherein step (c) further comprises concatenating said decompressed acoustic units with at least one cached acoustic unit.

19. The method of claim 17 further comprising, before step (a), transmitting a standard text corresponding to said normalized text to said server machine.

20. The method of claim 17 further comprising, before step (a), normalizing a standard text to obtain a normalized text, and transmitting said normalized text to said server machine.

21. A computer-readable medium storing a computer-executable program implementing the text-to-speech synthesis method of claim 20.

22. The method of claim 17, further comprising:

selecting parameters of said compression method to minimize the amount of data transmitted to said client machine while maintaining a minimum acoustic quality for each of said possible acoustic unit.

23. The method of claim 22, further comprising:

utilizing an optimized search directed by an acoustic metric that measures said minimum acoustic quality.

24. A computer-readable medium storing a computer-executable program implementing the text-to-speech synthesis method of claim 23.

25. A computer-readable medium storing a computer-executable program implementing the text-to-speech synthesis method of claim 22.

26. The method of claim 17 wherein steps (b), (c), and (d) occur before step (a) is completed.

27. A text-to-speech synthesis system programmed to perform the method of claim 17, said text-to-speech synthesis system comprising:

an acoustic unit database for storing said predetermined number of possible acoustic units;

said server machine in communication with said acoustic unit database;

said client machine in communication with said server machine; and means for enabling data transmission and communication among said acoustic unit database, said server machine, and said client machine.

28. The system of claim 27, wherein said client machine further comprises:

means for normalizing a standard text to obtain said normalized text; and means for transmitting said normalized text to said server machine.

29. The system of claim 27, wherein said client machine further comprises:

means for receiving said compressed acoustic units;

means for decompressing said compressed acoustic units; and means for concatenating said decompressed acoustic units.

30. The system of claim 27, wherein said client machine further comprises:

a cache memory for caching at least one uncompressed acoustic unit.

31. The system of claim 27, wherein said server machine further comprises:

means for normalizing a standard text to obtain said normalized text, wherein said standard text is received from said client machine or a different source, or is generated by said server machine.

32. A computer-readable medium storing a computer-executable program implementing the text-to-speech synthesis method of claim 17.

* * * * *